United States Patent [19]

Byland

[11] 4,033,089

[45] July 5, 1977

[54] PACKAGE WRAPPING METHOD AND APPARATUS

[76] Inventor: Henry Lowell Byland, 160 Bent Grass Drive, Roswell, Ga. 30075

[22] Filed: July 21, 1976

[21] Appl. No.: 707,338

[52] U.S. Cl. ..... 53/33; 53/210

[51] Int. Cl.[2] ..... B65B 11/12

[58] Field of Search ..... 53/33, 32, 210, 230

[56] References Cited

UNITED STATES PATENTS

| | | | |
|---|---|---|---|
| 3,546,836 | 12/1970 | Buob et al. | 53/33 |
| 3,816,969 | 6/1974 | Zimmerman et al. | 53/210 X |

*Primary Examiner*—Travis S. McGehee

*Attorney, Agent, or Firm*—Hill, Gross, Simpson, Van Santen, Steadman, Chiara & Simpson

[57] ABSTRACT

A method of automatically wrapping in plastic film a shallow tray filled with irregularly-shaped contents such as meat or vegetables is provided. No elevator for tray movement is required yet the method forms a lap seal on the bottom of the tray with any of the modern soft plastic films, including stretching and shrink films. The trays advance into a curtain of the plastic film arranged transversely to a tray feed track. A first air blower blows onto the film surface above the tray, billowing the film smoothly ahead of the tray to prevent folds from forming in the film and to keep moving air between the tray and the film during tray advance to avoid snagging therebetween. A lower edge of the film is captured between the tray bottom and tray support rollers. The film is draped over the top and back of the tray. A second fan blows air upwardly onto the undertucked film to ensure proper placement thereof. A tucking device displaces the support rollers downwardly and tucks and forms a lap joint between the film ends beneath the stationary tray. End folders then tension and fold the tubed ends of the film upwardly to the sides of the tray and downwardly to the bottom of the tray prior to shrinking or final heat treatment of the film.

12 Claims, 9 Drawing Figures

PACKAGE WRAPPING METHOD AND APPARATUS

BACKGROUND OF THE INVENTION

1. Field of the Invention

The present invention relates to methods and apparatus for automatically wrapping each of a series of articles in plastic, especially open trays filled with food products to be secured and protected in the tray.

2. The Prior Art

Automatic wrapping machines have found wide use in providing a thin, clear, and tough plastic film to a variety of articles, large and small. A major use of such machines is found in retail food stores, wherein plastic or fiber trays are filled with meat or vegetable products and sealed on all sides by a thin plastic wrap. The wrap contains the contents and protects them against contamination and also facilitates handling and sale of the product. Such wrapping of produce is done at the retail site, and machines are frequently operated by relatively inexperienced personnel, thus requiring that the machines be simple to use and safe, as well as efficient and quick in operation.

Generally, prior art devices have employed at least one elevator in the folding, wrapping, and sealing processes. In these machines, the package or tray starts at one level and is at some point lifted to a higher level for folding or stretching the film over the article. U.S. Pat. No. 3,378,990, issued to the present inventor, is representative of modern, compact semi-automatic wrapping machines. U.S. Pat. No. 3,791,101 discloses placing the film curtain across the path of advance of a package, whereby motion of the package from one support surface to the next wraps the front, bottom, and top of the package in the plastic film for subsequent formation of a lap seam on the rear of the package.

SUMMARY OF THE INVENTION

A method is provided for automatically wrapping in a plastic film a shallow tray filled with irregular contents, comprising the steps of supporting the film at upper and lower edges thereof transversely to a path of advance of the tray. The film is prevented from wrinkling at its vertical, side edges and from prematurely catching upon the tray by directing a wide stream of air onto the film from the side of advance of the tray. As the tray is advanced horizontally into the film, feed rolls feed sufficient film to encircle the package with an overlap allowance. The film is then cut and the feed rolls stop feeding simultaneously. After cutting, the bottom edge of the film is drawn up and captured between a bottom of the tray and support rolls onto which the tray is carried. A second stream of air is directed onto the captured bottom edge to prevent its falling from the bottom of the package. The top edge of the film is lowered behind the tray and the film clamps are released, draping the contents of the tray with the film. A tucker and undersealer device advances beneath the tray, simultaneously camming downwardly individual support rolls and folding the original top edges of the film beneath the tray and joining the film to itself in a lap joint. The tucker and undersealer device is then retracted, and the tray is advanced horizontally over the rolls to an end folding station. A lower portion of each side tube of film is tucked upwardly against one of the tray sides, and then the film tube is folded downwardly past the tray sides and tucked beneath the tray bottom.

DESCRIPTION OF THE PREFERRED EMBODIMENTS

Figure 1:
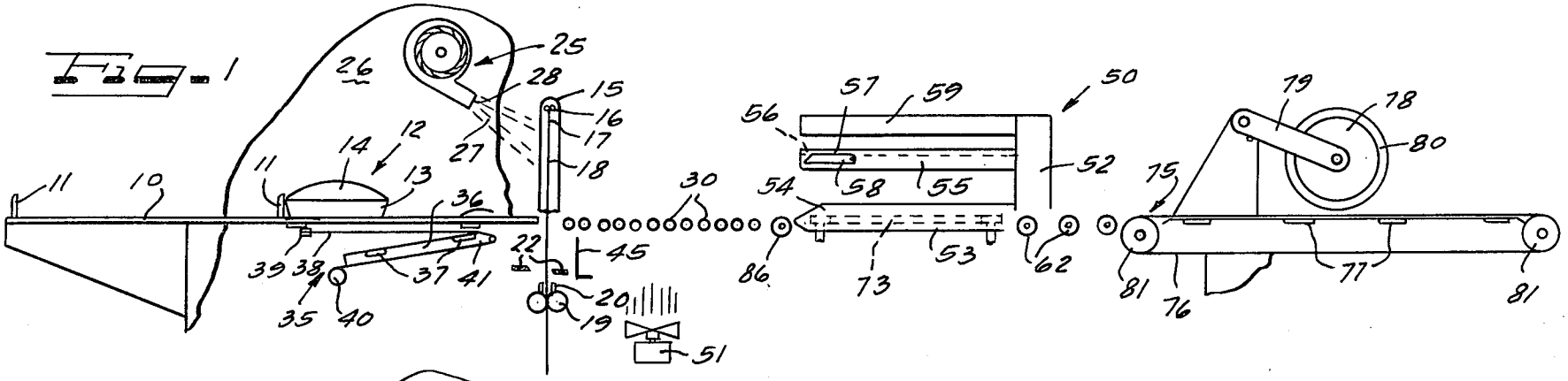
FIG. 1–6 are each schematic side elevation views, partially sectioned, showing operation stages in the wrapping of a tray.

In FIG. 1 is shown a generally schematic view of an automatic wrapping machine adapted to practice the steps of the present invention. Beginning at the left end of the Figure, a feed table 10 is provided extending in the horizontal direction and receiving slidably and reciprocably thereon a pair of longitudinally-spaced feed fingers 11. The fingers 11 retract into the feed table 10 on their leftward movements, so that successive packages 12 placed on the table 10 will be passed to the right. A package sensing switch finger 87 is attached to the table 10 forwardly of a rest position of the second of the feed fingers 11.

An article 12 to be wrapped comprises a shallow tray 13 comprised of pressed fiber, or plastic, or any similar material capable of holding it own shape. The tray 13 is generally rectangular in shape having four sides and a bottom, although the inventive method is equally applicable to round or other-shaped packages. Placed in the tray 13 is a mass of contents 14, which may be meat, vegetables, or other articles which are desired to be wrapped. Although the article 14 is shown rounded like a pie or a patty of ground meat, the method is equally applicable to irregularly-shaped articles such as whole chickens, squash, or machine parts.

A film clamp and support lever 15 extends vertically with respect to the feed table 10 and just beyond a right end thereof. A film feed sensing switch finger 88 senses package length and signals proper film length for wrapping thereof. A photoelectric control may be employed instead. The clamp 15, also shown in plan view in FIG. 7, carries a plurality of clamping fingers 16 on an upper transverse bar thereof, the fingers 16 being adapted to grasp and retain an upper edge 17 of a plastic film 18. The film clamp 15 is vertically reciprocable with respect to a pair of film feed rollers 19 located beneath the feed tables 10 and just beneath a fixed pair of film guide fingers 20. The plastic film 18 extends to the clamp fingers 16 through the feed rollers 19 and the guide fingers 20, with the rollers 19 applying a tension to the film 18 toward a lower edge 21 of the film 18. A pair of film cut knives 22 is provided on either side of the film 18 to sever the film sheet and to form the lower edge 21 thereof at a proper point in the machine operation sequence. Plastic film is supplied to the feed rollers 19 from a roll of film, not shown, within the machine.

Arranged upwardly from the feed table 10 is a blower 25 which is supported by a wall 26 of the machine in any convenient manner to direct a wide stream of air across the entire surface of the plastic film 18 from the side from which the package 12 advances thereinto. As shown in end view in FIG. 7, the film blower 25 has an air outlet 28 which is wider than the width of the plastic film 18 in a transverse direction. Although the blower 25 is shown as a self-contained centrifugal blower, any suitable source of a stream of air 27 may be employed.

Located on the opposite side of the film clamp and support 15 from the feed table 10 is a series of transversely-extending package support rollers 30 arranged with their upper circumferences substantially at the plane of the feed table 10. The support rollers 30 are spaced slightly apart in the longitudinal direction to permit free, idling rotation thereof. Each roller 30 is spring-biased to the position of FIGS. 1–3, but is vertically downwardly cammable in cooperation with movement of an unersealer device 35. A second air blower 51 is positioned beneath the rollers 30 to direct air upwardly against the underside of the package at the front thereof.

The girth wrap folder and undersealer device 35 is normally positioned beneath the feed table 10. The folder and undersealer 35 comprises a platen 36 having a pair of electric heaters 37 in an upper surface thereof. A Teflon coated fiberglass curtain 38 is affixed at one end of the machine frame at a clamp 39 and at its other end to a tension roll 40 carried on the movable platen 36. The curtain 38 extends beneath the feed table 10, around a nose 41 of the platen 36, and along an undersurface thereof to the tension roll 40. The roll 40 applies a constant end-wise tension to the curtain 38. The platen 36 is movable to the position shown in FIG. 4 by an appropriate cam linkage which simultaneously depresses successive individual support rolls 30 as the nose 41 of the platen 36 moves to the right. Portions of curtain 38 do not move horizontally once unrolled past the nose 41 of the platen 36, permitting application of heat from the elements 37 to the film 18 and tray 13 with no sliding contact between such moveable elements and the bottom of a package 12.

Located beneath the support rolls 30 and between the first and second such rolls from the left, is a vertically reciprocable package fence 45. The fence 45 is connected to cooperate with the forwardmost of the feed fingers 11, extending upwardly behind an advanced package 12 and then allowing retraction and leftward movement of the feed finger 11 without interference.

A heated roller 86 is positioned at the end of the series of rollers 30. This roller, comprising a heating element inside an aluminum tube, assures proper finish of the lap seal.

Figure 5:
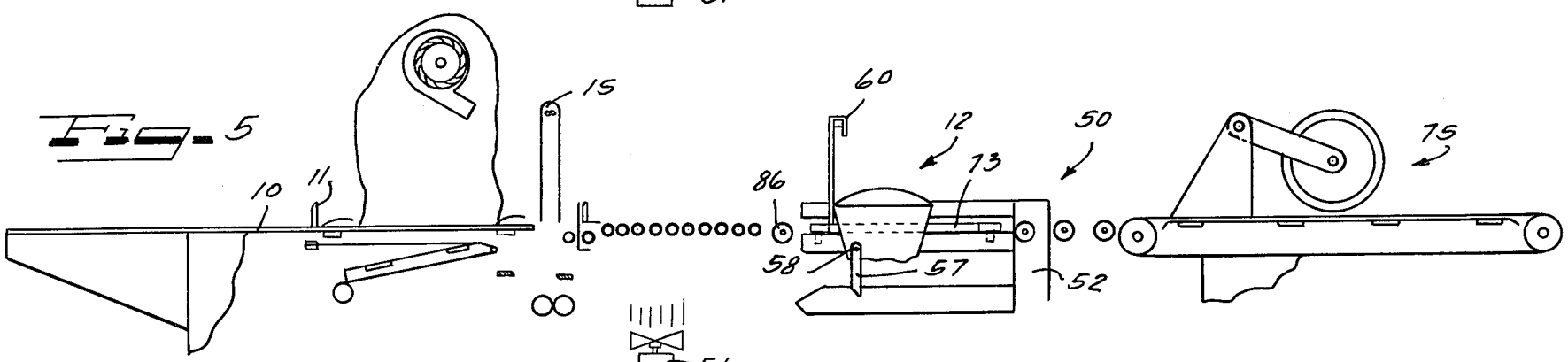
Figure 7:
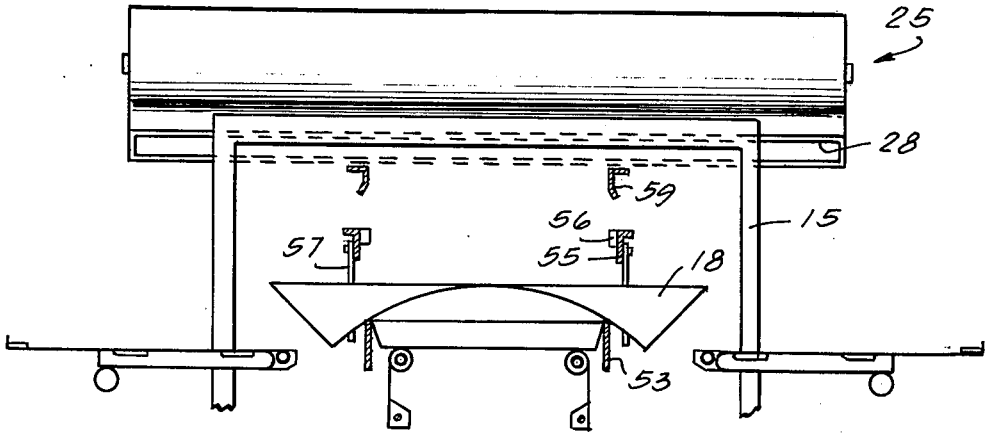
FIGS. 7–9 are each schematic end views taken on a section through the end folding station and showing further steps in the practice of the present invention.
Figure 8:
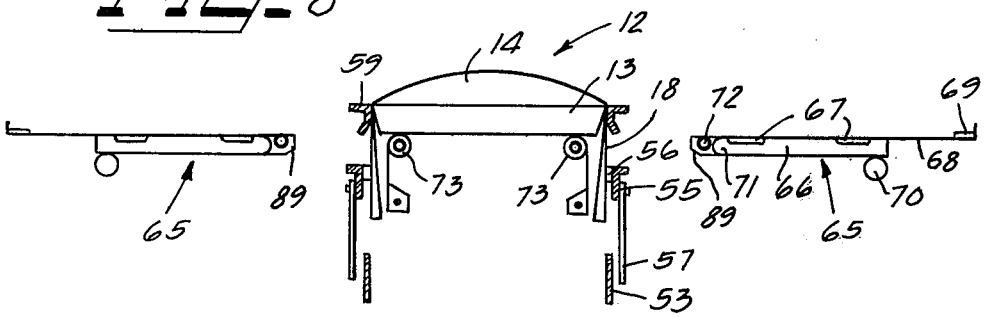
Figure 9:
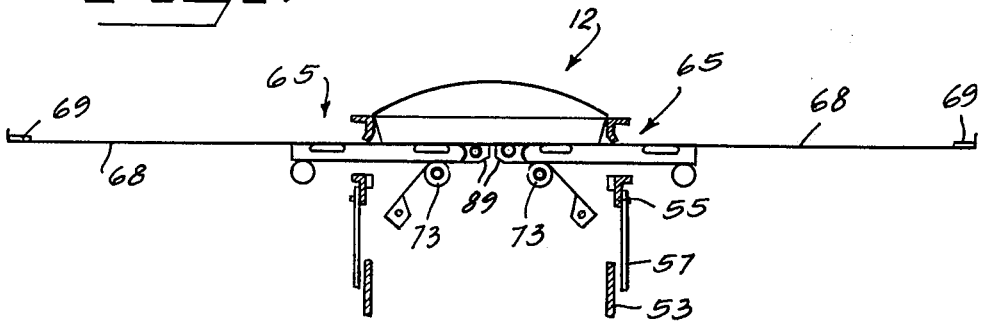

Further to the right of the rollers 30, 86 in the machine mechanism of FIG. 1 is an end folding, tucking, and sealing station 50. The station 50 comprises package support rollers 73 having tops located in the same plane as the feed table 10 and the tops of the support rolls 30. As shown in FIGS. 1 and 7, three horizontal bars extend longitudinally of the machine from a vertical bar 52 on either side of the package track. A lower bar 53 has an inclined leading edge 54 which forms a front tucker for the lower portion of the semi-wrapped package. The next upward bar 55 is an end folder and is fitted with a friction edge 56, comprising a strip of rubber or similar material along an upper, inner edge thereof. A rear tucker bar 57 is pivotally mounted upon each end folder bar 55 at pivot point 58 and is controlled by a cam linkage to gather rear portions of the plastic film 18 in the end tucking process. An upper bar 59 is a package guide bar, spaced from the first bar 53 to lie alongside the package as end wrapping is completed as shown in FIGS. 5, 8, and 9. The two sets of bars 53, 55, 59 and the package support rollers 73 are adjustably spaceable laterally from one another to accommodate different package widths.

An overhead feed finger 60 is selectively lowerable to engage the rear of the package 12 after girth wrapping and to feed it forwardly over the support rolls 30, through the end tucking and folding station 50, and over additional rollers 62 to a heated conveyor belt at the right end of the machine.

As shown in FIGS. 8 and 9, a pair of end underfolders and sealers 65 are provided on an underside of the end folding and sealing station 50. The end underfolder-sealer devices are much like the girth wrap folder and undersealer device 35 in having a platen 66 with heated bars 67 in the upper surface thereof. A Teflon-coated fiberglass curtain 68 is attached to the machine frame at 69 and is tensioned by a tension roller 70 carried on the lower rear surface of the platen 66. The curtain 68 extends about a nose 71 of the platen 66. Friction bars 72 just forwardly of the nose 71 of each of the underfoldersealers 65 stretch the film tightly at the ends as the underfolders and sealers 65 advance. The underfolder sealers 65 each have a cam surface 89 on an end thereof.

The end underfolder platens 66 are moveable inwardly toward one another beneath the package 12, displacing longitudinally-extending package support rollers 73 with the cams 89 to permit the heating elements 67 to press against the undersurface of the tray.

The heated conveyor belt 75 comprises an endless loop 76 of material such as silicone-rubber, fiberglass or Teflon-coated fiberglass. A series of heaters 77 are provided either transversely as shown or longitudinally under the belt 76 to insure a tight sealing of the plastic film 18 to itself on the bottom of the tray 13. A package pressure wheel 78 is pivotally mounted with respect to the heated conveyor 75 by a pivot link 79. The wheel 78 is covered with a soft silicone rubber rim 80. The weight of the wheel 78 atop the package 12 assures that proper contact is made between the package 12 and the conveyor 76 to seal any loose edges or fringes of plastic wrap. Th conveyor 75 is driven through one of the end rollers 81 thereof.

OPERATION

In accordance with the principles of the method of the present invention, the tray 13 filled with contents 14 of meat, vegetables, or other articles, is placed on the feed table 10 of the wrapping machine forwardly of one of the feed fingers 11. A width adjustment is made to the transverse spacing of the end bars 53, 55, 59 of the folding device 50 to accommodate the particular width of tray 13 employed. Also, a selection of correct width of plastic film 18 may be made from a number of available rolls. Generally a large number of similar-width trays 13 may be wrapped at one time, minimizing the need to change the width adjustments. Heater controls are turned on if required and adjusted for proper temperature depending upon the particular sort of film 18 employed.

A main drive motor of the machine will cause the feed fingers 11 to move to the right across the top of the feed table 10. As the feed fingers 11 begin moving forward, and if the package switch 87 is closed, the clamping fingers 16 on the film support 15 close over the end 17 of the plastic film 18 in or just above the film guide fingers 20 upwardly or the film feed rolls 19. The lever 15 is raised to the position shown in FIG. 1, forming a curtain with the film 18 across the path of advance of the package 12. The film blower 25 causes a blast or stream of air to billow the film curtain ahead of the advancing package 12 to prevent folds from forming in the film. As the package 12 is advanced into and through the curtain, the blast of air also causes moving air to be kept between the tray and its contents to reduce snagging between the film and the package. As the package 12 advances more film is fed by feed rolls 19 actuated by sensing finger 88.

Figure 2:
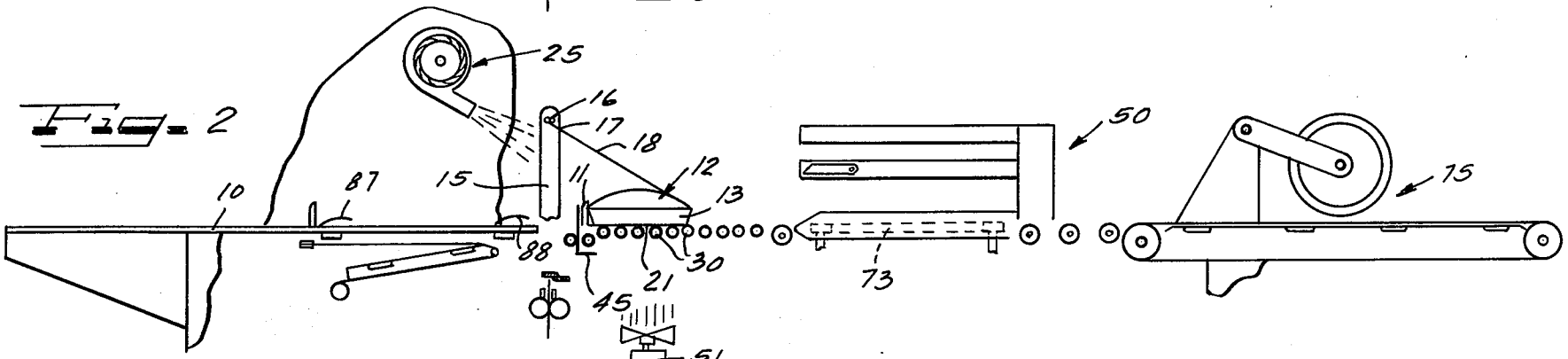

After the correct amount of film is fed, the the knives 22 are actuated by a spring-release tripped by a limit switch actuated by the package feed. The knife action forms a lower edge 21 on the exposed plastic film 18. As the package 12 continues to advance onto the support rolls 30, the lower edge 21 of the film 18 is, as shown in FIG. 2, pressed by the rolls 30 upon the tray 13. The end 21 is maintained in position by the air blower 51. The film 18 is then pulled taut between the bottom of the tray 13 and the pressure on the film 18 at the clamp fingers 16. When the feed fingers 11 reach their forward-most position, the package fence 45 rises above the level of the support rolls 30 to prevent rearward motion of the package 12 under the tension of the film 18, and the fingers 11 are withdrawn to the left. The air blower 25 may be, although in automatic operation usually is not, shut off after the package 12 is advanced to its forward-most position.

Figure 3:
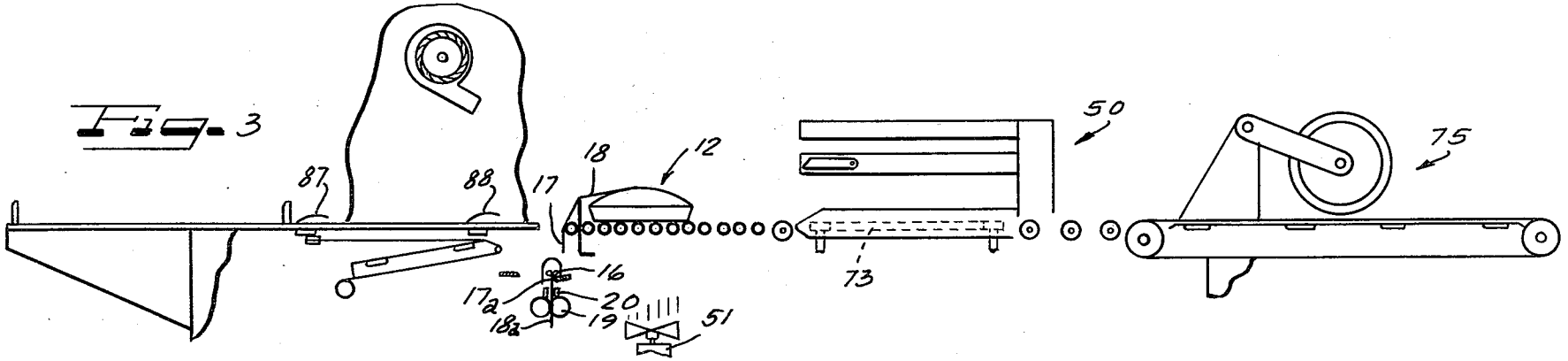

Between FIGS. 2 and 3, the film clamp and support lever 15 falls beneath the level of the feed table 10, carrying the upper end 17 of the plastic film 18 down behind the package 12. The clamp fingers 16 are released from the film 18 and travel further downwardly to engage an upper edge 17*a* of a next sheet of plastic film 18*a* to be drawn from the feed rollers 19 in or just above the guide fingers 20.

Figure 4:
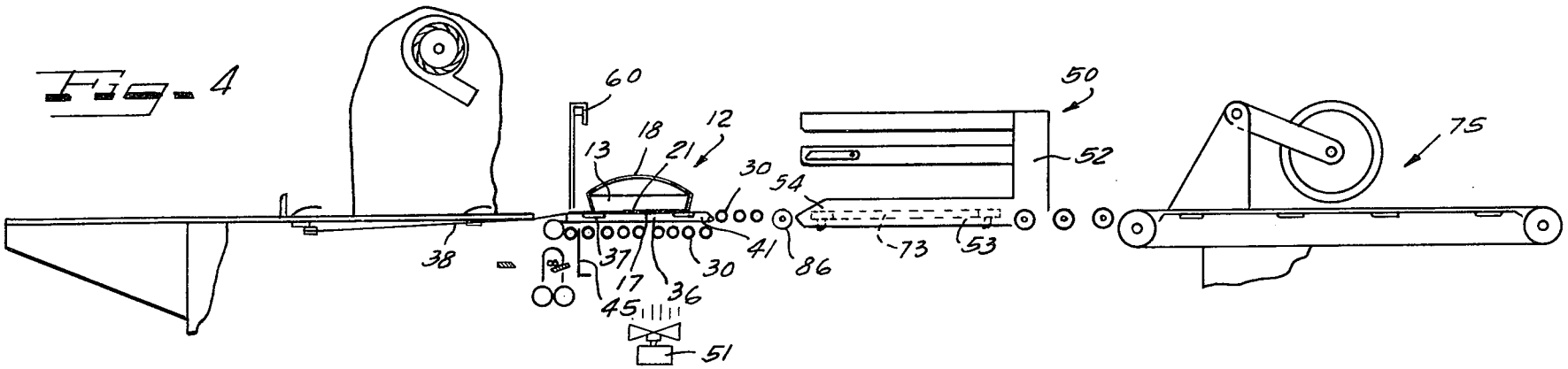

As shown in FIG. 4, in the next steps of the process, the package fence 45 is withdrawn vertically downwardly, and the folder and undersealer platen 36 is extended from the rest position of FIG. 3 to the plane of the top of the feed table 10 and the package roll 30. As the platen 36 is inserted between the leftmost rolls 30 and the bottom of the tray 13, the end 17 of the plastic film 18 is engaged and folded about the rear side of the tray 13 and tucked flat beneath the tray. Full forward movement of the heated platen 36 forms a lap seal between the edge 17 of the wrap and the edge 21, which is captured between the edge 17 and the tray 13. The heating elements 37 transfer heat through the fiberglass curtain 38 to seal the film 18 to itself at this lap joint. Since the curtain 38 does not move horizontally after it passes by end or nose 41 of the platen 36, the film 18 is not disturbed by the substantially vertical falling away of the support rolls 30 and the immediate replacing thereof by the heated platen 36.

As the girth wrapping and undersealing is completed, platen 36 returns leftwardly and support rolls 30 return to their raised portions again supporting the package 12. The overhead feed finger 60 drops down behind the package 12. This feed finger 60 engages the rear of the package 12 and slides it forwardly over the support rolls 30, over the heated roller 86, and into the end folding, tucking, and sealing station 50. Simultaneously, as shown in FIG. 5, the film clamp and support lever 15 rise above the level of the feed table 10. If the clamp fingers 16 have been closed by the sensing device 87 which detects a package on the table 10 forwardly of the right feed finger 11, the process of FIGS. 1–4 will be repeated for such package.

The girth-wrapped package 12 as it lay on the package support rolls 30 just before movement by the overhead feed finger 60 had a completed girth wrap thereabout, with the plastic film 18 formed as a tube thereabout and extending to either side of the package 12. As the package 12 is moved forwardly by the overhead feed finger 60 into the end folding, tucking, and sealing station 50, the underside front surfaces of the tube ends of the film 18 are tucked upwardly against the sides of the tray 13 by the inclined forward portion 54 of the front tucker bar 53. The package 12 then comes to a stop in the station 50 as shown in FIG. 5, and the rear tucker 57 pivots downwardly about the pivot point 58 to gather forwardly any trailing film 18. The end tucker and folder assemblies 52 then descend, to the positions of FIGS. 5 and 8, flattening the tube ends of the film 18 and folding them downwardly along either side of the tray 12. The friction edges 56 on the end folder bars 55 engage the film 18 and pull it downwardly over the top of the package 12 and the contents 14 therein. The package 12 is then held laterally in the position of FIGS. 5 and 8 by the package guide bars 59 supported vertically upon the package support rollers 73.

The end underfolder-sealers 65 are moved laterally inwardly, engaging the flattened tube ends of the film 18 and driving them inwardly and upwardly against the undersurface of the tray 13 and the girth wrap of plastic film 18 thereover. The cam surfaces 89 displace pivotally the longitudinally-extending support rollers 73 as the end underfolder-sealers are plunged beneath the tray 13. The underfolder-sealers 65 are withdrawn after the film 18 has been adhered to itself beneath the tray 13 leaving the tray 13 again supported by the support rollers 73.

Figure 6:
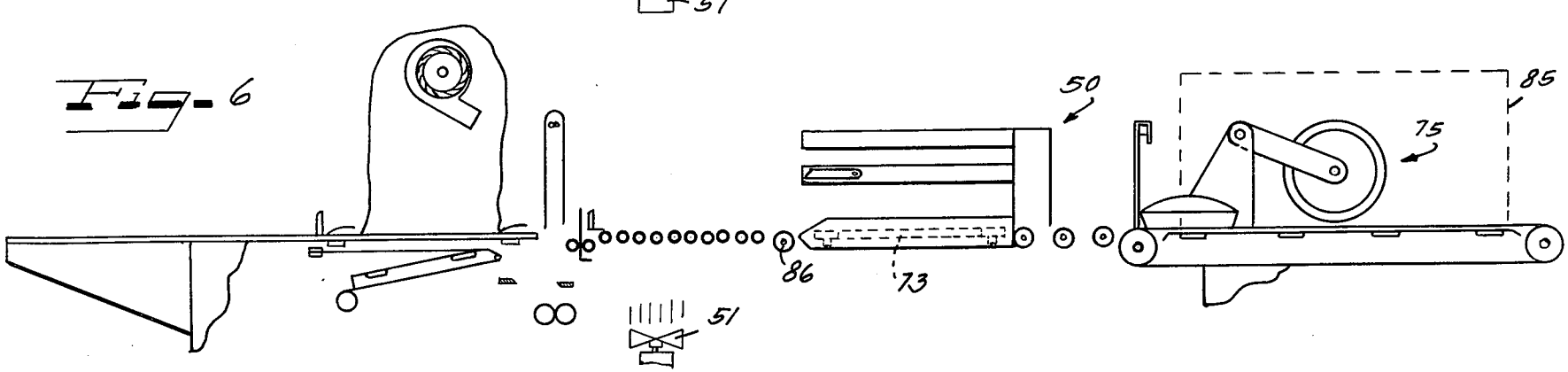

As a final step in the wrapping of the package 12, the overhead feed finger 60 moves the enclosed package 12 from the end folder station 50 across the rollers 62 to the heated conveyor belt 75. The belt 75 flattens any loose portions of plastic film 18 which had not been completely adhered to the tray 13 and subject the entire bottom of the tray 13 to heating by the elements 77 positioned under the conveyor belt 76. The pressure roller wheel 78 assures firm contact between the bottom of the tray 13 and the belt 76 and heating element 77 for good heat flow. Where shrink film is used, a shrink tunnel 85 as shown schematically in FIG. 6 is placed about the heated conveyor 75.

Although various minor modifications may be suggested in the disclosed methodology by those versed in the art, it should be understood that I wish to embody within the scope of the patent warranted hereon all such modifications as reasonably and properly come within the scope of my contribution to the art.

I claim as my invention:

1. The method of automatically wrapping in a sheet of plastic film a tray filled with contents, comprising the sequential steps:

a. feeding said film between rollers driven in syncronization with tray travel and supporting said film at upper and lower edges thereof transversely to a path of advance of said tray;

b. preventing said film from wrinkling at its vertical edges and from prematurely catching upon said tray by directing a stream of air wider than said film onto said film from a side of advance of said tray;

c. advancing said tray horizontally into said film, and simultaneously releasing a bottom edge of said film to be drawn up and captured between a bottom of said tray and a support surface on which said tray is carried as the tray advances entirely past the initial position of said film;

d. lowering the top edge of said film down behind said tray to drape said contents of said tray with said film; and e. inserting a tucker and undersealer device between said surface and said tray, simultaneously folding said top edge of said film beneath said tray and joining said film to itself in a lap joint, thereby forming a pair of tubes to each side of said tray.

2. A method as defined in claim 1, wherein between steps *c* and *d* a package fence is raised behind said tray to prevent backwards movements thereof as said top edge of said film is lowered and tightened, and said fence being lowered between steps *d* and *e*.

3. The method of claim 1, further comprising between steps *d* and *e* a step of directing a second stream of air onto the bottom of said tray and said bottom edge of said film and maintaining this stream during step *e*, to maintain said bottom edge against said tray during formation of the lap joint by the tucker and undersealer device.

4. The method of claim 1, further comprising the sequential steps following step *e:* f. retracting said tucker and undersealer device;

g. advancing said tray horizontally to an end folding station;

h. tucking a lower portion of each film tube adjacent said tray upwardly against a corresponding one of said tray sides;

i. folding each of said film tubes downwardly past said tray sides; and j. tucking said film tubes flat beneath said tray bottom.

5. The method of claim 4, wherein step *i* further includes stretching said film tightly over said tray contents.

6. The methods of claim 4, further comprising after the step *j* the further step:

k. advancing said tray horizontally from said end folding station to a heated conveyor surface.

7. The method of claim 6, further comprising the step of advancing the tray horizontally through a shrink tunnel.

8. A method of automatically wrapping in a plastic film a rectangular tray filled with irregular contents, comprising the sequential steps:

a. forming a curtain of a length of said plastic film across a path of advance of said tray by supporting said film at top and bottom edges thereof;

b. blowing a stream of air onto a side of said film in said advance direction;

c. advancing said tray into said curtain and onto a surface extending in the tray advance direction, continuing to feed film until enough film is fed to satisfy the package size and to trigger a cut off knife, and releasing the severed bottom edge of said curtain, thereby to engage a front edge of said tray and a bottom portion thereof above said surface with said film;

d. lowering said curtain across and down behind said tray;

e. tucking and sealing said film from behind said tray to the underside of said tray above said surface, forming a lap seal in said film to itself and a pair of film tubes on either side of said tray;

f. advancing said package along said surface to an end folding and tucking station;

g. folding a lower portion of said film tubes to the lower sides of said tray;

h. lowering and flattening said film tubes downwardly across the sides of said tray; and i. tucking and sealing said flattened film tubes beneath and to the bottom of said tray above a retracted support surface thereof.

9. The method of claim 8, wherein the stream of air blown in steps *b* through *d* is sufficiently strong to prevent said film from wrinkling at its edges as said tray is advanced into said film and to form an air gap between said film and said tray as said tray advances.

10. The method of claim 8, wherein step *e* thereof is accomplished by retracting said surface downwardly as a tucking and sealing element is passed between said surface and the bottom of said tray.

11. The method of claim 10, further comprising simultaneously with step *e* directing a second stream of air against an underside of said tray and said bottom edge of said film thereagainst to maintain said film in flat contact with the underside of said tray.

12. A mechanism for automatically wrapping a tray in a sheet of plastic film comprising:

first means for supporting said film at upper and lower edges thereof transversely to a path of advance of said tray;

second means for preventing said film from wrinkling at its vertical edges and from prematurely catching upon said tray, said second means directing a stream of air wider than said film onto said film from a side of advance of said tray;

third means for advancing said tray horizontally into said film;

fourth means for simultaneously releasing a bottom edge of said film to be drawn up and captured between a bottom of said tray and a support surface on which said tray is carried as the tray advances entirely past the initial position of said film:

fifth means for lowering the top edge of said film down behind said tray to drape said contents of said tray with said film; and sixth means for inserting a tucker and undersealer device between said surface and said tray and for simultaneously folding said top edge of said film beneath said tray and joining said film to itself in a lap joint, thereby forming a pair of tubes on each side of said tray.

* * * * *